US007040867B2

(12) United States Patent
Louthan et al.

(10) Patent No.: US 7,040,867 B2
(45) Date of Patent: May 9, 2006

(54) COMPRESSOR WHEEL JOINT

(75) Inventors: Gary R. Louthan, Westminster, CA (US); Angela R. Taberski, Irvine, CA (US); Corey G. Marugg, San Jose, CA (US); Sara R. Chastain, Hermosa Beach, CA (US)

(73) Assignee: Honeywell International, Inc., Morristown, NJ (US)

( * ) Notice: Subject to any disclaimer, the term of this patent is extended or adjusted under 35 U.S.C. 154(b) by 134 days.

(21) Appl. No.: 10/723,446

(22) Filed: Nov. 25, 2003

(65) Prior Publication Data

US 2005/0111998 A1 May 26, 2005

(51) Int. Cl.
*F04D 29/62* (2006.01)

(52) U.S. Cl. ..... 416/244 A; 73/471

(58) Field of Classification Search ..... 416/204 R, 416/244 A, 244 R, 144, 1, 61; 415/119; 417/406, 407, 409; 74/573 R; 73/66, 455, 73/471

See application file for complete search history.

(56) References Cited

U.S. PATENT DOCUMENTS

| | | | |
|---|---|---|---|
| 2,695,131 | A | 11/1954 | Price |
| 3,152,483 | A | 10/1964 | Hemmeter |
| 3,232,043 | A | 2/1966 | Birmann |
| 3,421,201 | A | 1/1969 | Oberke et al. |
| 3,451,343 | A | 6/1969 | Kabele |
| 3,510,230 | A | 5/1970 | Raub |
| 3,571,906 | A | 3/1971 | Barth et al. |
| 3,676,014 | A | 7/1972 | Bevan et al. |
| 3,693,985 | A | 9/1972 | Dillner |
| 3,782,201 | A | 1/1974 | Fitts |
| 3,846,044 | A | 11/1974 | Shank |
| 3,890,780 | A | 6/1975 | Hagemeister et al. |
| 3,914,067 | A | 10/1975 | Leto |
| 3,961,867 | A | 6/1976 | Woollenweber |
| 4,039,268 | A | 8/1977 | Cotton |
| 4,074,946 | A | 2/1978 | Swearingen |
| 4,095,856 | A | 6/1978 | Markovitz |
| 4,125,344 | A | 11/1978 | Tiefenbacher |
| 4,128,283 | A | 12/1978 | Palmer |
| 4,147,468 | A | 4/1979 | Murakami et al. |
| 4,157,834 | A | 6/1979 | Burdette |
| 4,279,576 | A | 7/1981 | Okano et al. |
| 4,286,467 | A | 9/1981 | Kober |
| 4,296,934 | A | 10/1981 | Atkin |
| 4,340,317 | A | 7/1982 | Heitmann et al. |
| 4,538,969 | A | 9/1985 | Ammann et al. |
| 4,543,825 | A | 10/1985 | Schonfeld et al. |
| 4,613,281 | A | 9/1986 | Lubieniecki |
| 4,688,427 | A | 8/1987 | Hyland |
| 4,705,463 | A | 11/1987 | Joco |
| 4,850,820 | A | 7/1989 | Gutknecht |

(Continued)

FOREIGN PATENT DOCUMENTS

| | | |
|---|---|---|
| DE | 716090 | 1/1942 |

(Continued)

*Primary Examiner*—Edward K. Look
*Assistant Examiner*—Richard A. Edgar
(74) *Attorney, Agent, or Firm*—Chris James

(57) ABSTRACT

An exemplary compressor wheel includes a proximate end, a distal end, an axis of rotation, a z-plane positioned between the proximate end and the distal end, and a joint having an axis coincident with the axis of rotation and an end surface positioned between the z-plane and the distal end. Other exemplary joints, compressor wheels, chambers, systems and/or methods are also disclosed.

19 Claims, 10 Drawing Sheets

U.S. PATENT DOCUMENTS

| | | | | |
|---|---|---|---|---|
| 4,872,817 | A | 10/1989 | Kruif | |
| 4,944,660 | A | 7/1990 | Joco | |
| 4,986,733 | A | 1/1991 | Fleury et al. | |
| 5,176,497 | A | 1/1993 | Deacon et al. | |
| 5,193,989 | A | 3/1993 | Fleury et al. | |
| 5,314,106 | A | 5/1994 | Ambroziak et al. | |
| 6,032,466 | A * | 3/2000 | Woollenweber et al. | 60/607 |
| 2003/0136001 | A1 | 7/2003 | Nishiyama et al. | |
| 2004/0057834 | A1 * | 3/2004 | Shimizu | 416/244 A |
| 2005/0036893 | A1 * | 2/2005 | Decker | 416/244 A |

FOREIGN PATENT DOCUMENTS

| | | | |
|---|---|---|---|
| EP | 0138516 | A1 | 4/1985 |
| EP | 0129311 | B1 | 7/1987 |
| WO | PCT/US04/39358 | | 4/2005 |

* cited by examiner

COMPRESSOR WHEEL JOINT

TECHNICAL FIELD

Subject matter disclosed herein relates generally to methods, devices, and/or systems for compressors and, in particular, compressors for internal combustion engines.

BACKGROUND

Compressors wheels may be component balanced using a balancing spindle and/or assembly balanced using a compressor or turbocharger shaft. Each approach has certain advantages, for example, component balancing allows for rejection of a compressor wheel prior to further compressor or turbocharger assembly; whereas, assembly balancing can result in a better performing compressor wheel and shaft assembly.

For conventional "boreless" compressor wheels, balancing limitations arise due to aspects of the boreless design. In particular, conventional boreless compressor wheels require shallow shaft attachment joints to minimize operational stress. While conventional shallow joints can pose some tolerable limitations for component balancing of aluminum compressor wheels, for component balancing of titanium compressor wheels, such shallow joints introduce severe manufacturing constraints. To overcome such constraints, a need exists for a new joint. Accordingly, various exemplary joints, compressor wheels, balancing spindles, assemblies and methods are presented herein.

BRIEF DESCRIPTION OF THE DRAWINGS

A more complete understanding of the various method, systems and/or arrangements described herein, and equivalents thereof, may be had by reference to the following detailed description when taken in conjunction with the accompanying drawings wherein.

DETAILED DESCRIPTION

Various exemplary devices, systems and/or methods disclosed herein address issues related to compressors. For example, as described in more detail below, various exemplary devices, systems and/or methods address balancing of a compressor wheel.

As mentioned in the Background section, some differences exist between aluminum boreless compressor wheels and titanium boreless compressor wheels. Titanium has a material strength and hardness that exceeds that of aluminum and hence titanium is more difficult to machine. Balancing processes need to account for machining difficulties associated with titanium. Accordingly, various exemplary compressor wheel joints allow for deep insertion of a balancing spindle and shallow insertion of a compressor or turbocharger shaft. Such deep joints act to alleviate manufacturing constraints exhibited by titanium compressor wheels having only shallow joints.

An overview of turbocharger operation is presented below followed by a description of conventional compressor wheel joints, exemplary compressor wheel joints, stress data for various compressor wheel joints, an exemplary balancing spindle and an exemplary method of compressor wheel balancing.

Figure 1:
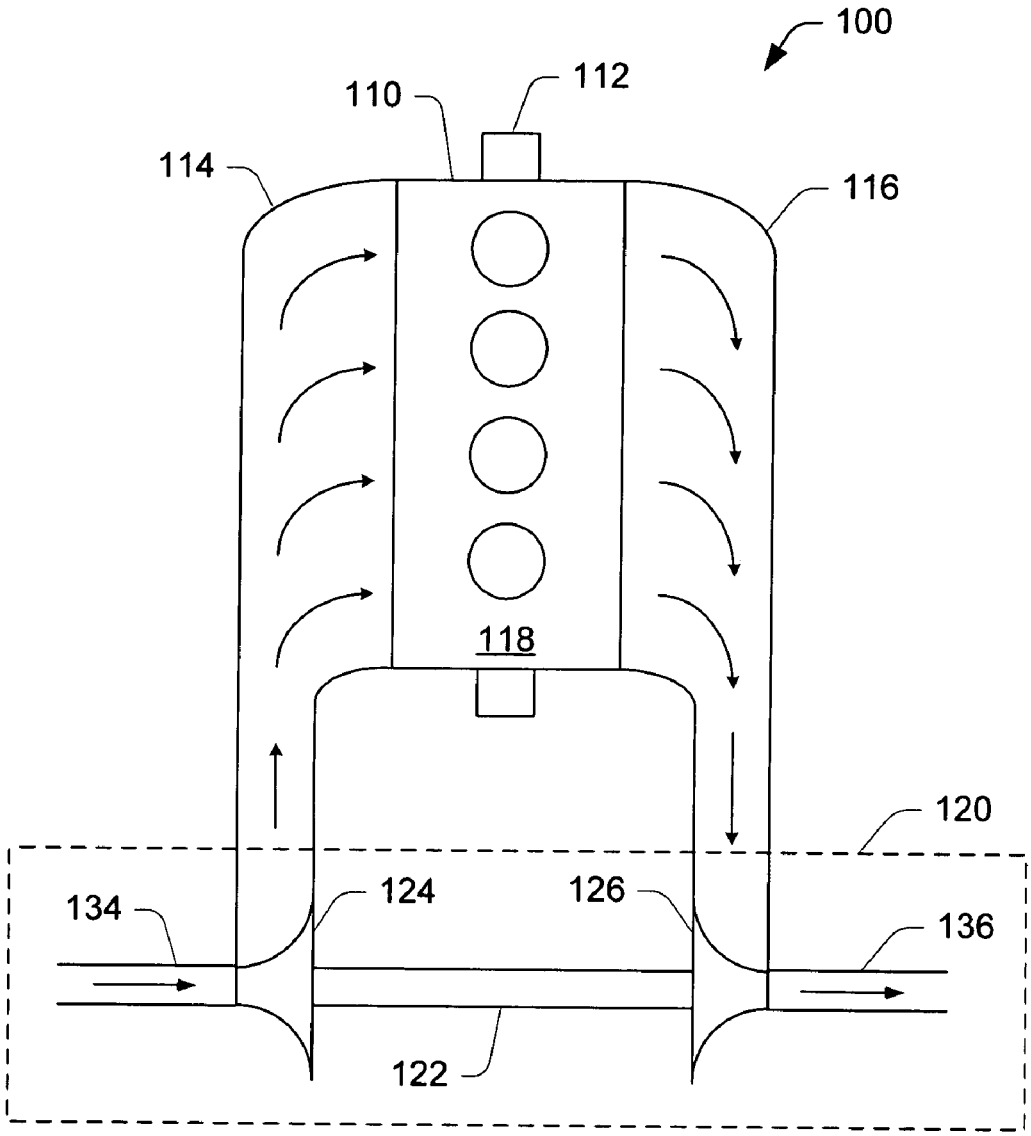
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, and an exhaust outlet 136. A wastegate or other mechanism may be used in conjunction with such a system to effect or to control operation.

The turbine 126 optionally includes a variable geometry unit and a variable geometry controller. The variable geometry unit and variable geometry controller optionally include features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine rotor in order to optimize turbine power with the required load. Movement of vanes towards a closed position typically directs exhaust flow more tangentially to the turbine rotor, which, in turn, imparts more energy to the turbine and, consequently, increases compressor boost. Conversely, movement of vanes towards an open position typically directs exhaust flow in more radially to the turbine rotor which, in turn, increase the mass flow of the turbine and, consequently, decreases the engine back pressure (exhaust pipe pressure). Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, various mechanisms may allow for boost pressure regulation which may effectively optimize power output, fuel efficiency, emissions, response, wear, etc. Of course, an exemplary turbocharger may employ wastegate technology as an alternative or in addition to aforementioned variable geometry technologies. Other exemplary turbochargers may include neither or other mechanisms.

Figure 2:
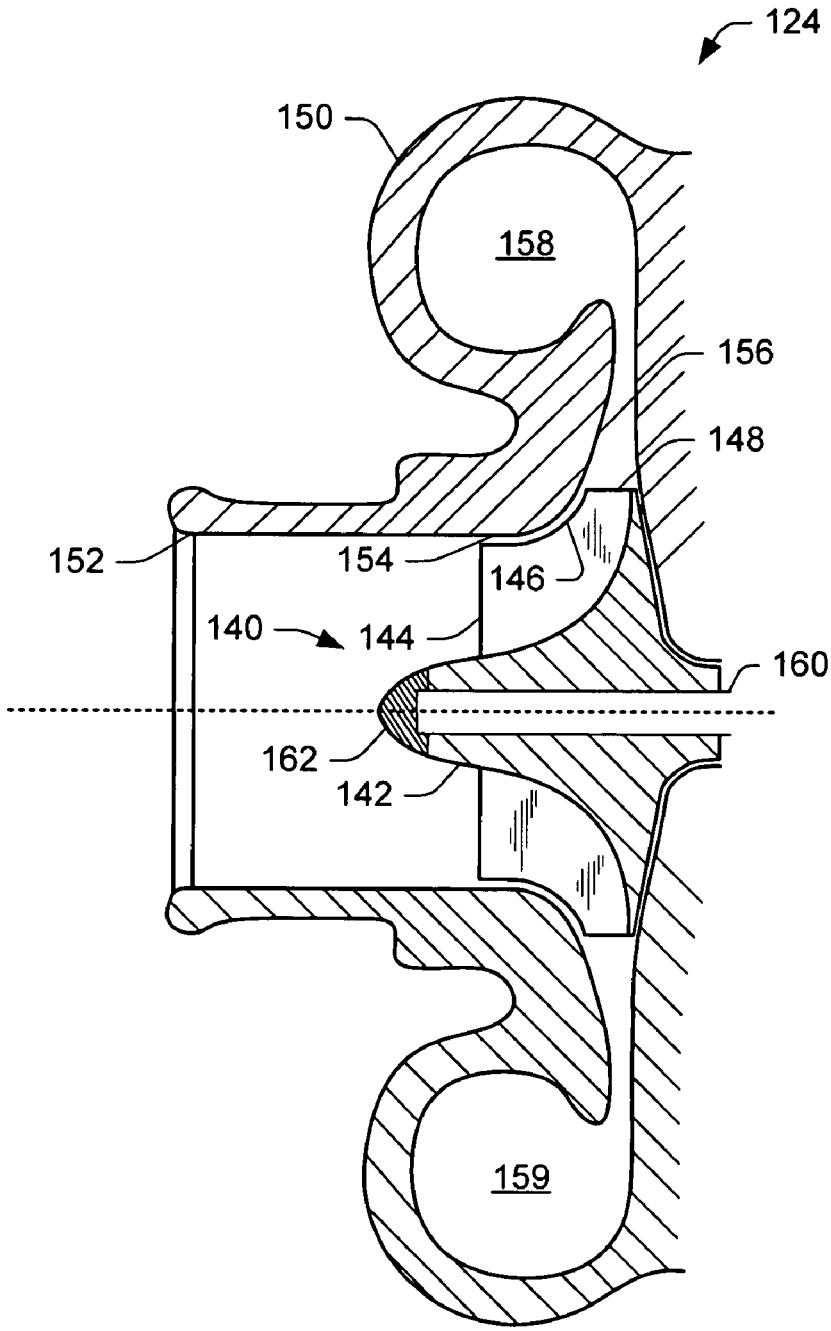
Fig. 2 (Prior Art)
FIG. 2 is a cross-sectional view of a prior art compressor assembly that includes a compressor shroud and a compressor wheel having a full bore.

FIG. 2 shows a cross-sectional view of a typical prior art compressor assembly 124 suitable for use in the turbocharger system 120 of FIG. 1. The compressor assembly 124 includes a housing 150 for shrouding a compressor wheel 140. The compressor wheel 140 includes a rotor 142 that rotates about a central axis (e.g., a rotational axis). A bore 160 extends the entire length of the central axis of the rotor 142 (e.g., an axial rotor length); therefore, such a rotor is referred to at times as a full-bore rotor. An end piece 162 fits onto an upstream end of the rotor 142 and may act to secure a shaft and/or to reduce disturbances in air flow. In general, such a shaft has a compressor end and a turbine end wherein the turbine end attaches to a turbine capable of being driven by an exhaust stream.

Referring again to the compressor wheel 140, attached to the rotor 142, are a plurality of compressor wheel blades 144, which extend radially from a surface of the rotor. As shown, the compressor wheel blade 144 has a leading edge portion 144 proximate to a compressor inlet opening 152, an outer edge portion 146 proximate to a shroud wall 154 and a trailing edge portion 148 proximate to a compressor housing diffuser 156. The shroud wall 154, where proximate to the compressor wheel blade 144, defines a section sometimes referred to herein as a shroud of compressor volute housing 150. The compressor housing shroud wall after the wheel outlet 156 forms part of a compressor diffuser that further diffuses the flow and increases the static pressure. A housing scroll 158, 159 acts to collect and direct compressed air.

In this example, some symmetry exists between the upper portion of the housing scroll 158 and the lower portion of the housing scroll 159. In general, one portion has a smaller cross-sectional area than the other portion; thus, substantial differences may exist between the upper portion 158 and the lower portion 159. FIG. 2 does not intend to show all possible variations in scroll cross-sections, but rather, it intends to show how a compressor wheel may be positioned with respect to a compressor wheel housing.

Figure 3:
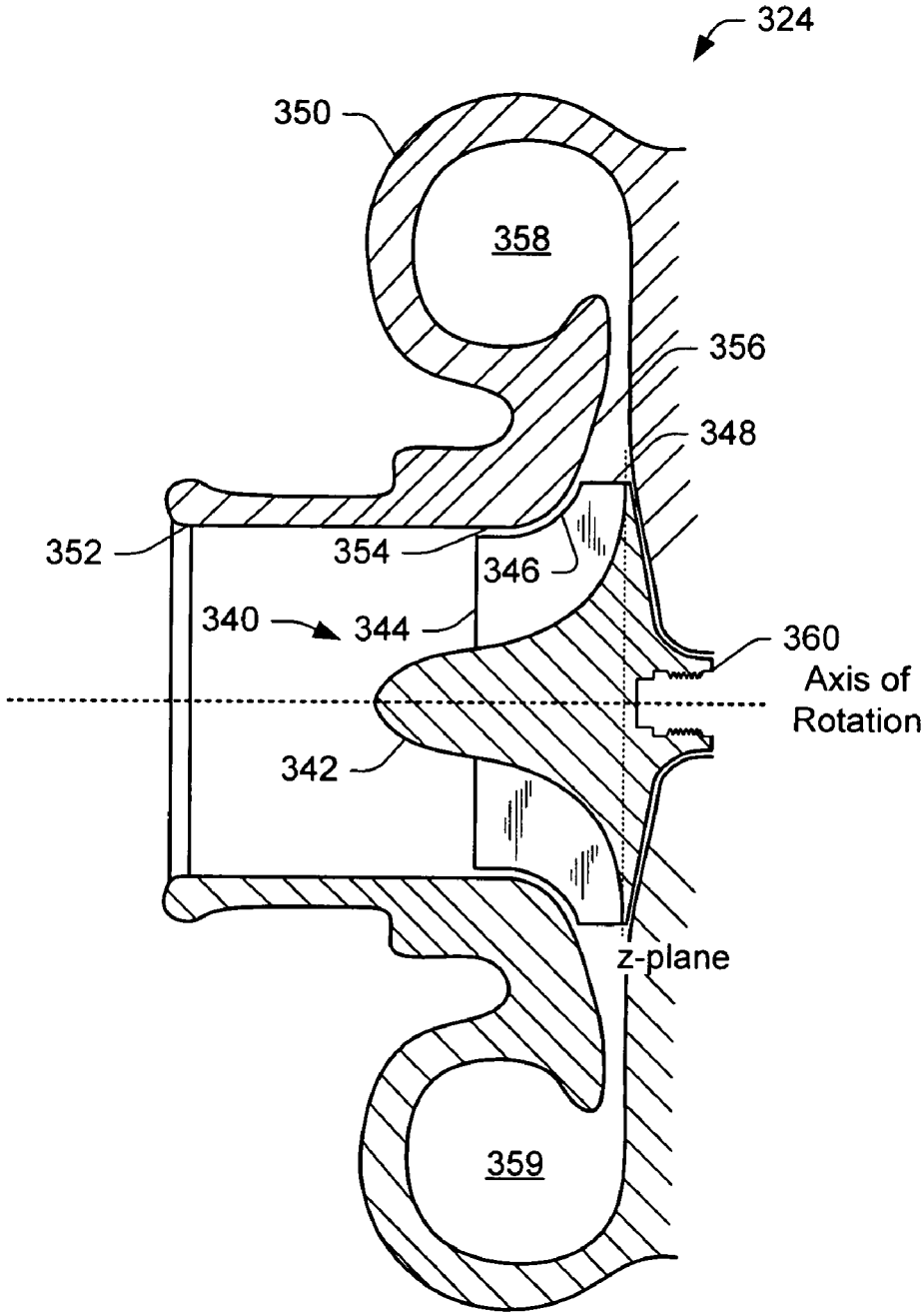
Fig. 3 (Prior Art)
FIG. 3 is a cross-section view of a prior art compressor assembly that includes a compressor shroud and a conventional "boreless" compressor wheel.

FIG. 3 shows a cross-sectional view of a conventional prior art compressor wheel rotor 324 that includes a "boreless" compressor wheel 340 suitable for use in the turbocharger system 120 of FIG. 1. The compressor assembly 324 includes a housing 350 for shrouding a compressor wheel 340. The compressor wheel 340 includes a rotor 342 that rotates about a central axis. Attached to the rotor 342, are a plurality of compressor wheel blades 344, which extend radially from a surface of the rotor. As shown, the compressor wheel blade 344 has a leading edge portion 344 proximate to a compressor inlet opening 352, an outer edge portion 346 proximate to a shroud wall 354 and a trailing edge portion 348 proximate to a compressor housing diffuser 356. The shroud wall 354, where proximate to the compressor wheel blade 344, defines a section sometimes referred to herein as a shroud of compressor volute housing 350. The compressor housing shroud wall after the wheel outlet 356 forms part of a compressor diffuser that further diffuses the flow and increases the static pressure. A housing scroll 358, 359 acts to collect and direct compressed air.

In this example, some symmetry exists between the upper portion of the housing scroll 358 and the lower portion of the housing scroll 359. In general, one portion has a smaller cross-sectional area than the other portion; thus, substantial differences may exist between the upper portion 358 and the lower portion 359. FIG. 3 does not intend to show all possible variations in scroll cross-sections, but rather, it intends to show how a compressor wheel may be positioned with respect to a compressor wheel housing.

FIG. 3 shows a z-plane as coinciding substantially with a lowermost point of an outer edge or trailing edge portion 348 of the blade 344. A bore or joint 360 centered substantially on a rotor axis exists at a proximate end of the rotor 342 for receiving a shaft. Throughout this disclosure, the bore or joint 360 is, for example, a place at which two or more things are joined (e.g., a compressor wheel and a shaft or a spindle, etc.). Compressor wheels having a joint such as the joint 360 are sometimes referred to as "boreless" compressor wheels in that the joint does not pass through the entire length of the compressor wheel. Indeed, such conventional boreless compressor wheels do not have joints that extend to the depth of the z-plane. The joint 360 typically receives a shaft that has a compressor end and a turbine end wherein the turbine end attaches to a turbine capable of being driven by an exhaust stream. For purposes of compressor wheel balancing, the joint 360 may receive a balancing spindle; however, such a balancing spindle cannot extend to or beyond the z-plane because of the joint depth.

Figure 4:
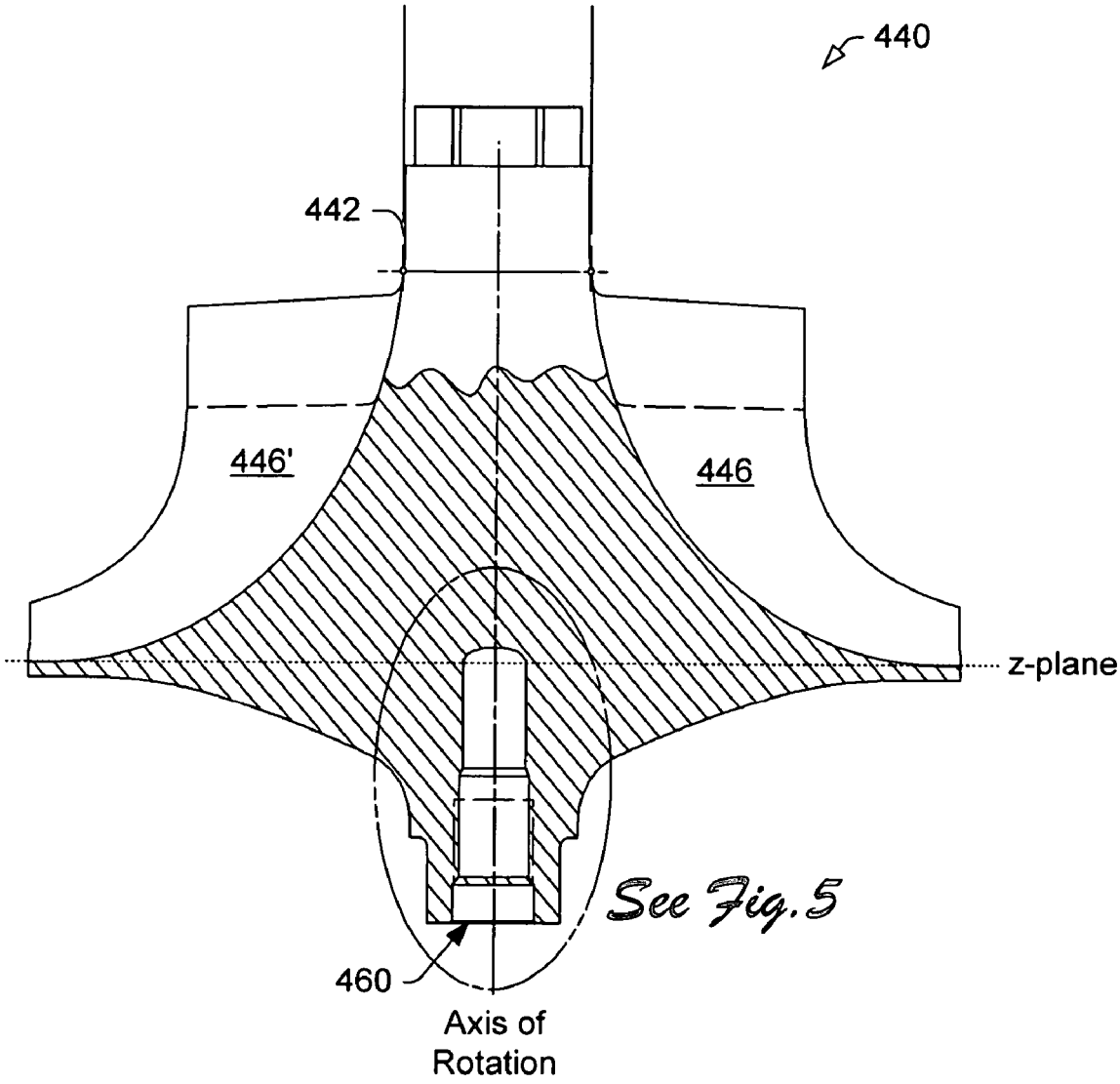
FIG. 4 is a cross-sectional view of an exemplary compressor wheel that includes an exemplary joint.

FIG. 4 shows a cross-sectional view of an exemplary compressor wheel 440. The compressor wheel 440 includes a rotor 442, one or more blades 446, 446' and an axis of rotation and a z-plane. At one end of the compressor wheel 440, a joint 460 exists that has an axis substantially coincident along the axis of rotation of the rotor 442. In this example, the joint 460 extends along the axis of rotation into the compressor wheel 440 to a depth slightly beyond the z-plane.

Figure 5:
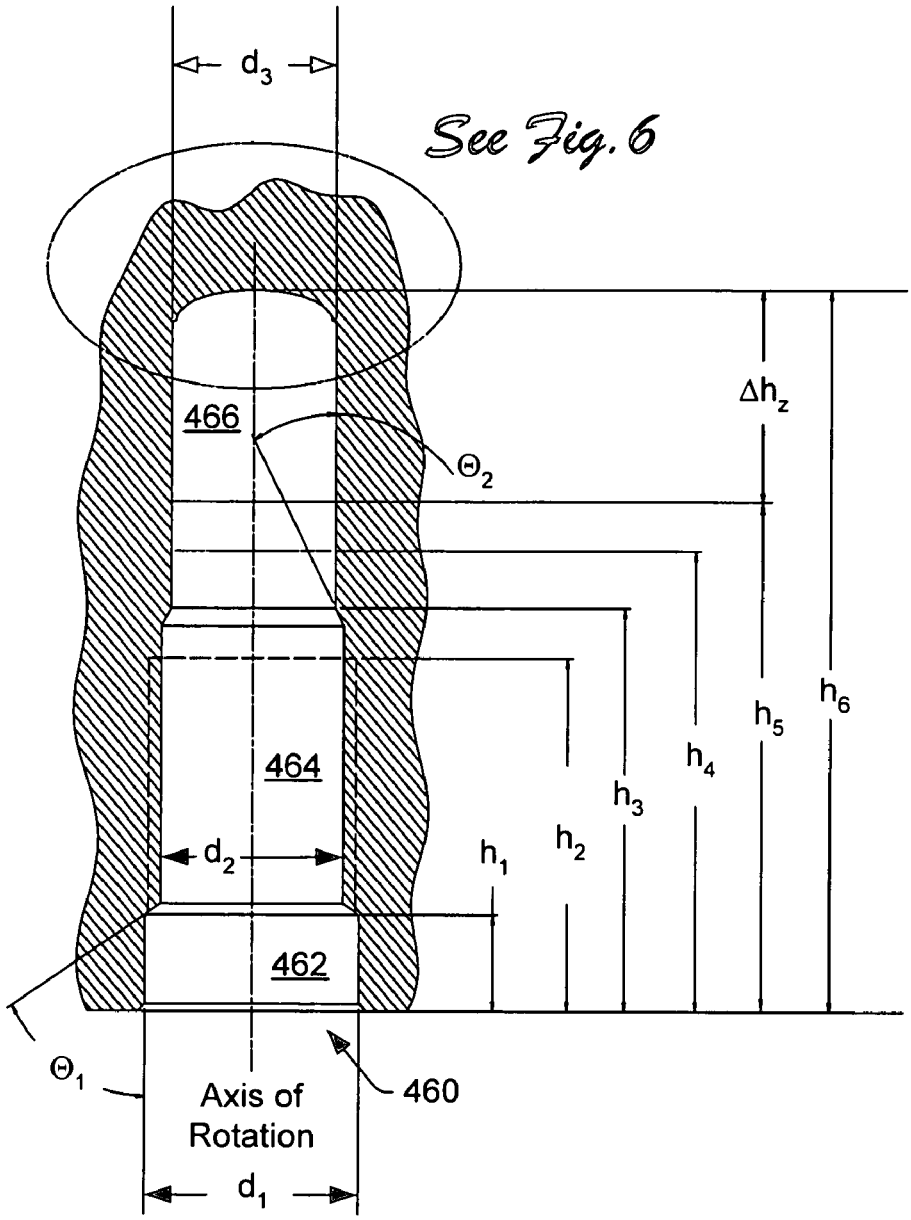
FIG. 5 is a cross-sectional view of the exemplary joint of the wheel of FIG. 4.

FIG. 5 shows a more detailed view of the exemplary joint 460. As shown, the joint 460 may be defined by one or more regions, volumes, surfaces and/or dimensions. For example, the exemplary joint 460 includes a proximate region 462, an intermediate region 464 and a distal region 466. Such regions may be referred to as pilot regions and/or co-pilot regions or threaded regions, as appropriate. The proximate region 462 includes a diameter $d_1$, and a length $h_1$ (or $\Delta h_p$), the intermediate region 464 includes a diameter $d_2$ and a length $h_3-h_1$ (or $\Delta h_i$), and the distal region 466 includes a diameter $d_3$ and a length $h_6-h_3$ (or $\Delta h_d$), wherein $d_1>d_2>d_3$ and wherein the depth of the joint 460 corresponds to the length $h_6$ (e.g., approximately the sum of $\Delta h_p$, $\Delta h_i$, and $\Delta h_d$).

The intermediate region 464 further includes threads or other fixing mechanism (e.g., bayonet, etc.), which extends a length $h_2-h_1$ between $h_1$ and $h_3$ and has a minimum diameter of approximately $d_2$. In one example, the intermediate region 464 includes approximately seven or more threads. In general, $h_2$ is less than $h_3$; however, $h_2$ may equal $h_3$. Where threads are included, the threads of the intermediate region 464 typically match a set of threads of a compressor shaft, turbocharger shaft, turbine wheel shaft assembly, etc. Further, such a shaft, when received by the joint 460, typically does not extend to a depth greater than the depth $h_4$. As shown in FIG. 5, while the depth $h_4$ extends to some extent into the distal region 466, it does not normally extend to or beyond a z-plane depth $h_5$. Further, such a shaft typically does not extend to the maximum depth of the joint 460 (e.g., the depth $h_6$). Accordingly, an exemplary assembly may include a joint (e.g., the joint 460) that includes a proximate region, an intermediate region and a distal region and a turbocharger shaft inserted at least partially in the joint, wherein the shaft extends to at least a depth of a distal region (e.g., the depth $h_3$). In such an exemplary assembly, a distal end of the shaft may actually extend into the distal region of the joint to a depth (e.g., the depth $h_4$) that is less than the total depth of the joint (e.g., the depth $h_6$). Again, in general, such a distal shaft end does not typically extend to or beyond the z-plane.

FIG. 5 also shows additional, optional details of the joint 460, including an annular constriction disposed near the juncture of the proximate region 462 and the intermediate region 464, an annular constriction disposed near the juncture of the intermediate region 464 and the distal region 466, and a curved surface at the end of the distal region 466. The one or more annular constrictions decrease in diameter with respect to increasing length along the axis of rotation and may form a surface disposed at an angle with respect to the axis of rotation. For example, the annular constriction disposed near the juncture of the proximate region 462 and the intermediate region 464 may include an angle $\Theta_1$ while the annular constriction disposed near the juncture of the intermediate region 464 and the distal region 466 may include an angle $\Theta_2$. In one example, the angle $\Theta_1$ includes one or more angles selected from a range from approximately 50° to approximately 70°. In one example, the angle $\Theta_2$ includes one or more angles selected from a range from approximately 20° to approximately 40°. Of course, an exemplary joint may include one or more annular constrictions where one includes one or more angles selected from a range from approximately 50° to approximately 70° and where another includes one or more angles selected from a range from approximately 20° to approximately 40°.

With respect to the annular constriction near the juncture of the intermediate region 464 and the distal region 466, such a constriction may act to minimize or eliminate any damage created by machining (e.g., boring, taping, etc.). Further, an exemplary joint may have a non-threaded sub-region of the intermediate region 464 adjacent to the distal region 466 or adjacent to an annular constriction adjacent to the distal region 466. The exemplary joint 460 includes a non-threaded or threadless sub-region of the intermediate region 464 having a length equal to or less than approximately $h_3-h_2$ (or $\Delta h_{nt}$). In one example, such a sub-region has a $\Delta h_{nt}$ to $\Delta h_i$ ratio of approximately 0.125 or less.

The exemplary joint 460 optionally includes a ratio between $d_1$, $d_2$ and $d_3$, wherein for a dimensionless $d_3$ of 1, $d_2$ is approximately 1.1 (e.g., minimum thread diameter) and $d_1$, is approximately 1.3. The exemplary joint 460 optionally includes a ratio between $d_1$, $d_2$ and $d_3$, wherein for a dimensionless $d_1$ of 1, $d_2$ is approximately 0.85 (e.g., minimum thread diameter) and $d_3$ is approximately 0.77.

With respect to the distal region 466, a length $h_5$ represents a length along the axis or rotation that corresponds to the z-plane of a compressor wheel, wherein the distance $h_5-h_6$ is equal to $\Delta h_z$, which is the distance between the z-plane and the end of the joint 460.

In one example, the ratio of the length $h_4$ to the length $h_6$ is equal to or greater than approximately 0.638 and optionally less than approximately 1. The distal region 466 typically serves as a joint to receive a portion of a balancing spindle wherein the portion of the balancing spindle has a diameter less than $d_2$ and approximately equal to $d_3$.

Various exemplary joints include: a relationship between $\Delta h_p$, $\Delta h_i$, and $\Delta h_d$ wherein for a normalized $\Delta h_d$ of 1, $\Delta h_i$ is approximately 0.97 and $\Delta h_p$ is approximately 0.3; a ratio of $\Delta h_d$ to $h_6$ of approximately 0.4 to approximately 0.5; and/or a ratio of $\Delta h_i$ to $h_6$ of approximately 0.4 to approximately 0.5.

Figure 6:
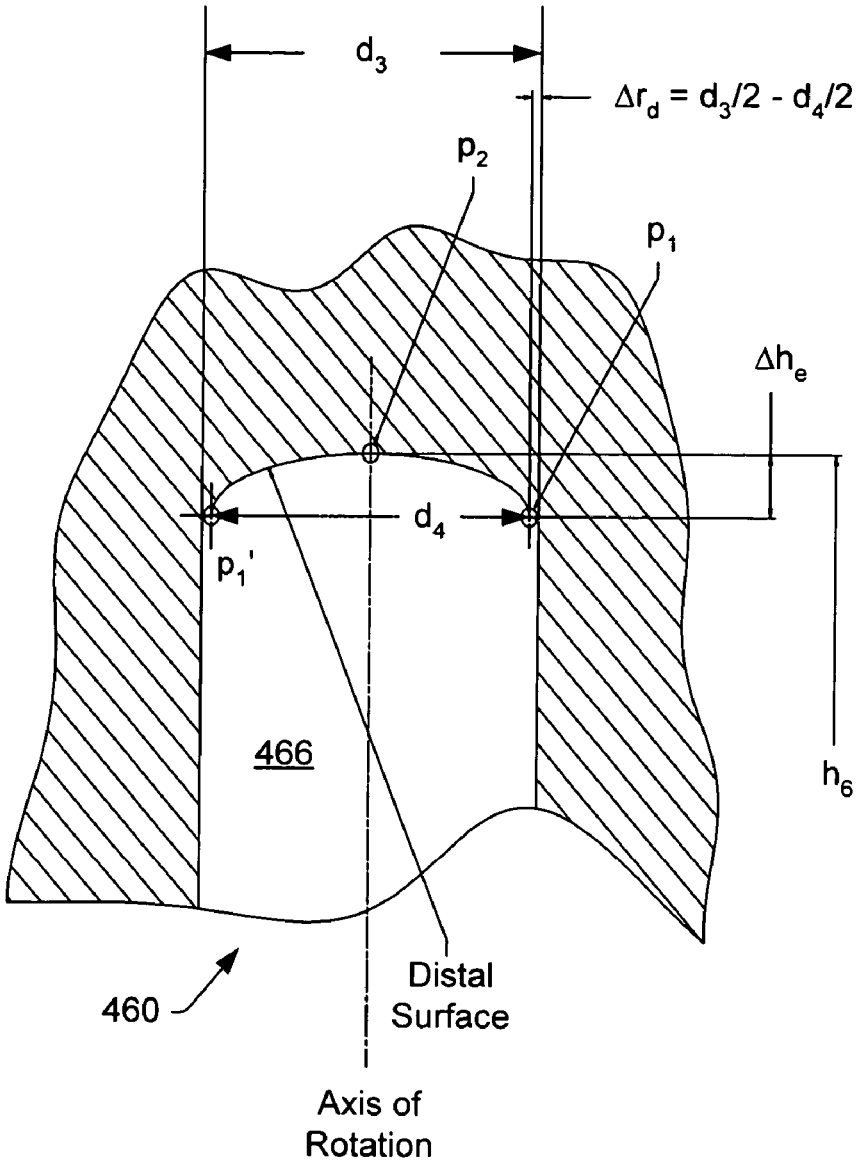
FIG. 6 is a cross-sectional view of an exemplary end surface of the joint of FIG. 5.

FIG. 6 shows a more detailed cross-sectional view of the distal region 466 of the exemplary joint 460. In this example, the distal region 466 has an end surface defined by three points $p_1$, $p_1'$ and $p_2$ wherein $p_2$ lies approximately along the axis of rotation and coincides approximately with the axial length $h_5$ (e.g., the depth of the joint 460). Points $p_1$, $p_1'$ and the point $p_2$ are separated by a length $\Delta h_e$. Thus, points $p_1$ and $p_1'$ are located at a length $h_5-\Delta h_e$ and along a diameter $d_4$ wherein, as shown, $\Delta r_d$ is approximately $d_3/2-d_4/2$ wherein $d_3$ is greater than or equal to $d_4$. In one example, the ratio of $d_4$ to $d_3$ is equal to or less than approximately 1.05. According to the exemplary joint 460, the end surface, in cross-section, has an elliptical shape and, more particularly, is approximately a 3:1 ellipse. For example, the ratio of 0.5 $d_4$ to $\Delta h_e$ is approximately 3:1. An exemplary joint may rely on the diameter $d_3$ or $d_4$ to determine the end surface shape. In general, the difference between $d_3$ and $d_4$ is small (e.g., a few percent of $d_3$). Further, an exemplary joint may have $d_3$ equal to $d_4$ (e.g., no shoulder, step, transition, etc.) and thus alleviate the need for definition of $d_4$. In another example, the end surface, in cross-section, has approximately a full radius or other shape that reduces stress.

As already mentioned, differences exist between aluminum boreless compressor wheels and titanium boreless compressor wheels. In particular, titanium has a material strength and hardness that exceeds that of aluminum and hence titanium is more difficult to machine. Balancing needs to account for machining difficulties associated with titanium; thus, various exemplary joints allow for deep insertion of a balancing spindle and shallow insertion of a compressor or turbocharger shaft. In general, deep insertion corresponds to insertion to or beyond the z-plane of the compressor wheel. While aluminum and titanium have been mentioned as materials of construction, materials of construction are not limited to aluminum and titanium and may include stainless steel, etc. Materials of construction optionally include alloys. For example, Ti-6Al-4V (wt.-%), also known as Ti6-4, is alloy that includes titanium as well as aluminum and vanadium. Such alloy may have a duplex structure, where a main component is a hexagonal $\alpha$-phase and a minor component is a cubic $\beta$-phase stabilized by vanadium. Implantation of other elements may enhance hardness (e.g., nitrogen implantation, etc.) as appropriate.

Figure 7:
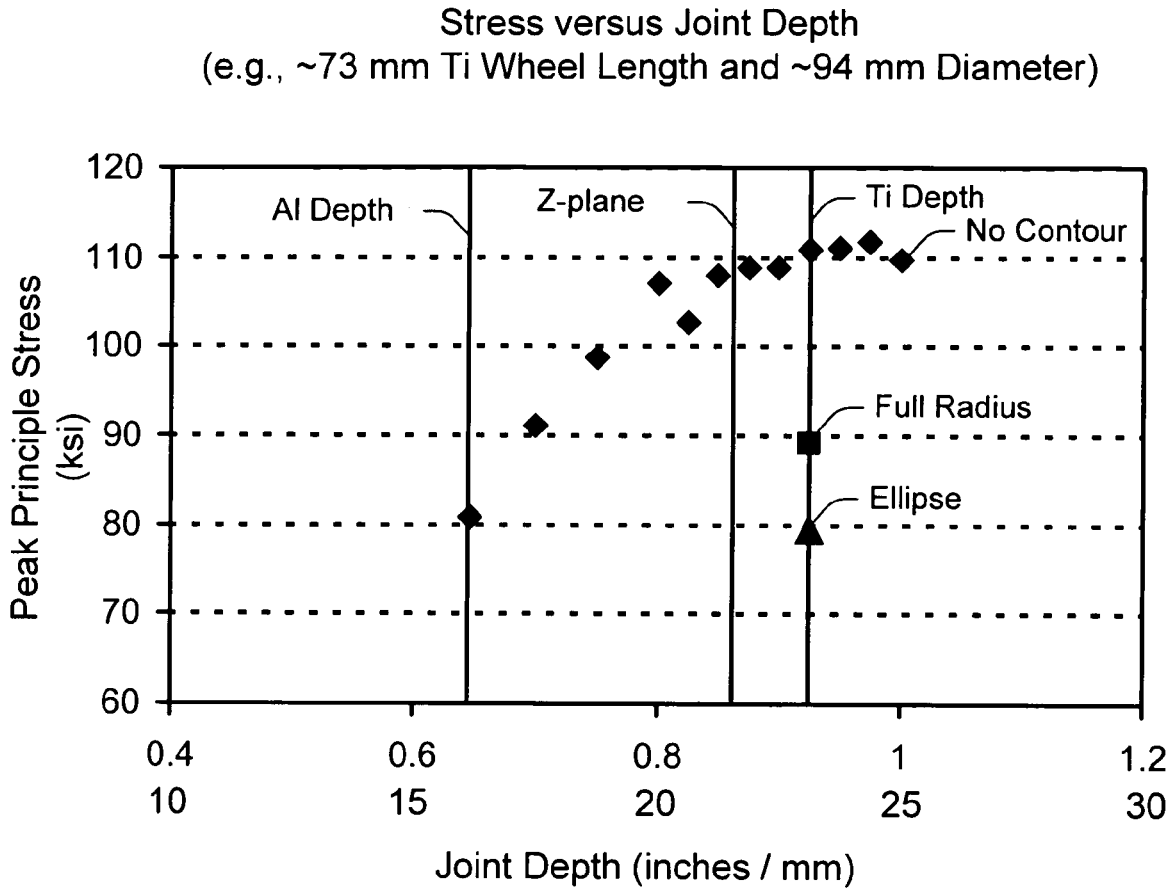
FIG. 7 is a plot of stress versus joint depth for conventional and exemplary joints.

FIG. 7 shows an exemplary plot 700 of stress data versus bore or joint depth for a titanium compressor wheel of total length of about 73 mm (e.g., about 2.9 inches) and a diameter of about 94 mm (e.g., about 3.7 inches). The plot 700 also indicates the joint depth for a conventional aluminum compressor wheel (e.g., about 0.64 inches or 16 mm) and a z-plane (e.g., approximately 22 mm). Data for no end shaping (e.g., no elliptical end shape, no full radius end shape, etc.) of a titanium compressor wheel indicate that peak stress in the compressor wheel increases with increasing joint depth wherein the peak stress increases to a lesser degree for joint depths beyond about 23.4 mm (or about 0.92 inches) or, with respect to a ratio of joint depth to z-plane, beyond about 1.05. At such depths, the peak principle stress is approximately 110 ksi, which corresponds approximately to the yield stress. However, with a full radius end surface, the peak stress is reduced from about 110 ksi to approximately 90 ksi (about a 20% decrease). Further, with the exemplary end surface of FIG. 6, the peak stress is reduced from 110 ksi to approximately 80 ksi (about a 30% decrease). Accordingly, in this example, the exemplary end shape results in a stress that is approximately equal to or less than the stress for an unshaped end at the conventional aluminum joint depth (e.g., about 1.6 cm).

Various exemplary titanium compressor wheels include an exemplary joint having a distal region with an elliptical end shape wherein joint depth allows for adequate balancing without introducing significant machining issues associated with drilling of the joint.

Figure 8:
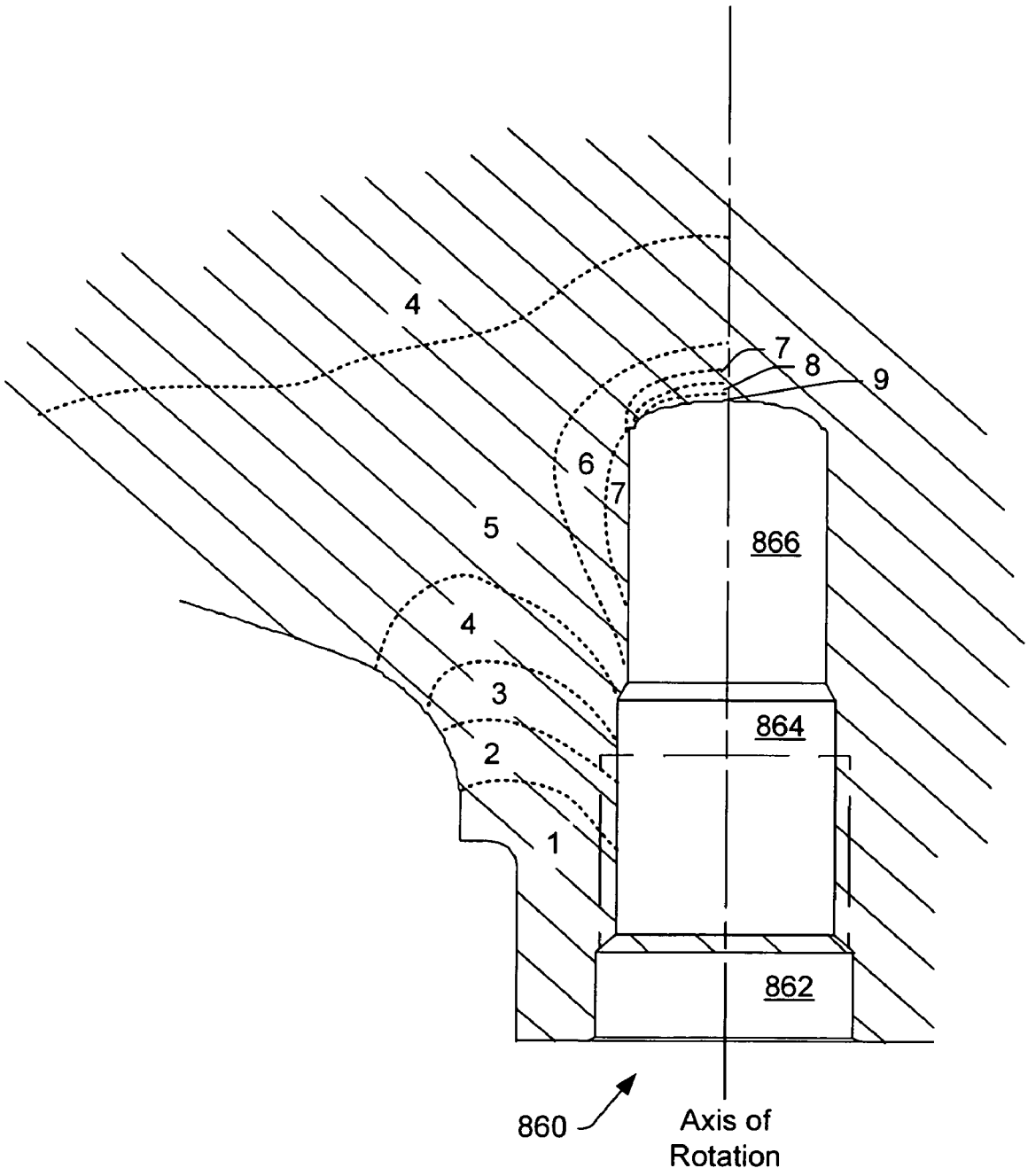
FIG. 8 is a contour plot of stress for an exemplary compressor wheel joint.

FIG. 8 shows a cross-sectional diagram 800 of an exemplary compressor wheel joint 860 along with stress contours (regions 1–9) due to the joint. The compressor wheel joint 860 has a proximate region 862, an intermediate region 864 and a distal region 866. Accordingly, the highest level of stress appears at the end of the distal region 866 wherein the region 9 corresponds to the highest stress and the region 1 corresponds to the lowest stress. In this example, the highest level of stress occurs proximate to the end surface of the distal region 866 and along the axis of rotation.

Figure 9:
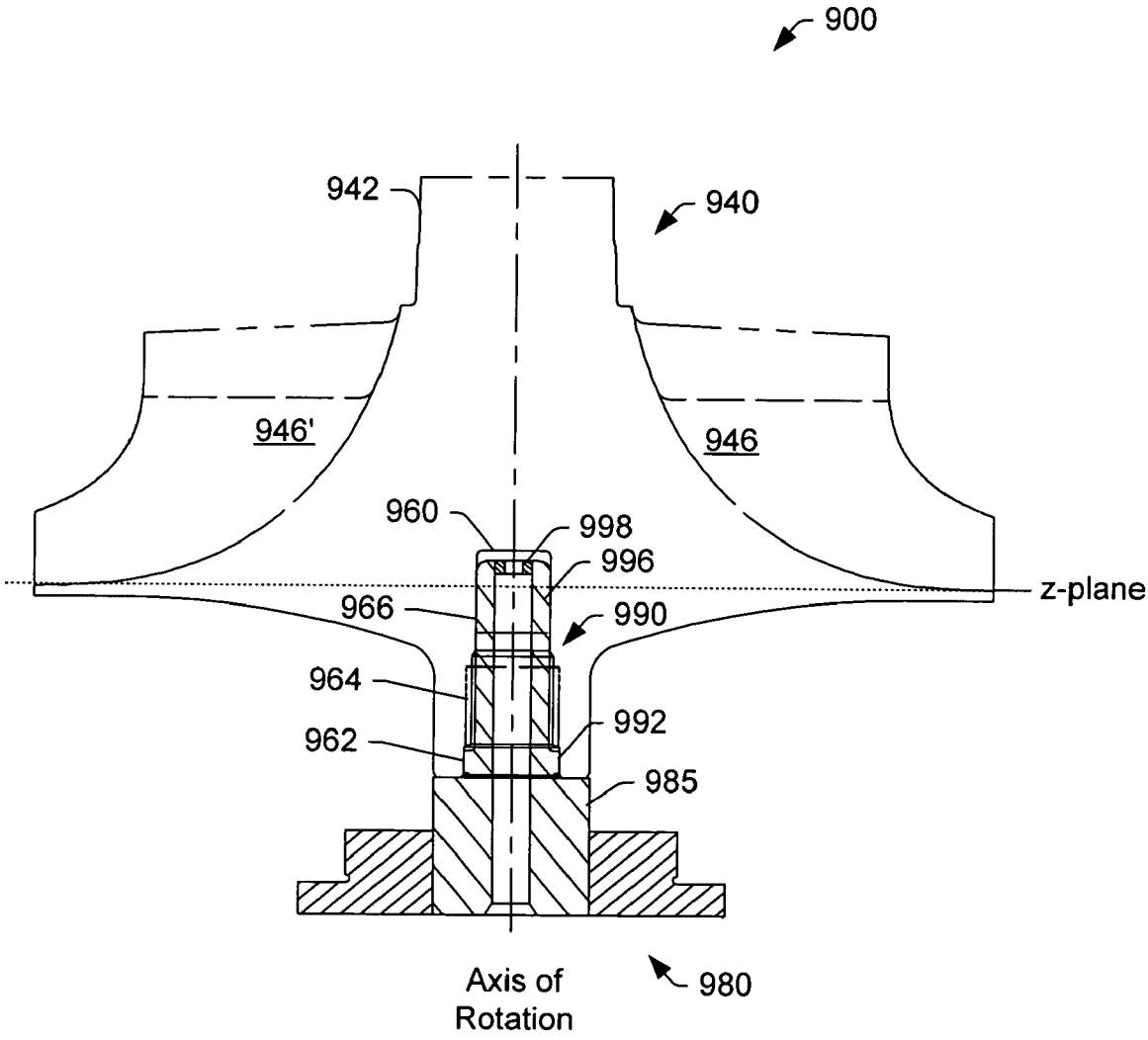
FIG. 9 is a cross-sectional diagram of an exemplary balancing spindle and compressor wheel and balancing spindle assembly.

FIG. 9 shows a cross-sectional view of an exemplary compressor wheel and balancing spindle assembly 900. The compressor wheel 940 includes a rotor 942, one or more blades 946, 946' and a joint 960 disposed in the hub 942. A balancing spindle unit 980 includes a base portion 985 and a spindle portion 990 that extends into the joint 960 of the compressor wheel 940. The spindle portion 990 includes a proximate spindle section 992 and a distal spindle section 996. The proximate spindle section 992 extends into the proximate region 962 of the joint 960 and distal spindle section 996 extends into the distal region 966 of the joint 960 to a depth beyond the z-plane of the compressor wheel 940. In this example, the distal spindle section 996 includes an upper end 998 that has an aperture to allow for pressure equalization between the joint 960 and the spindle portion 990. Of course, a side or other channel or mechanism may allow for pressure equalization.

In general, the balancing spindle unit 980 stabilizes a balancing process due to the depth of insertion achieved by the spindle portion 990 into the joint 960. Overall, such a joint operates to receive a balancing spindle at a depth suitable for balancing and to receive a shaft at a depth suitable for operation in, for example, a turbocharger.

In contrast, a conventional joint provides locating points for a balancing spindle as pilot diameters (e.g., the intermediate region) and co-pilot diameters (e.g., the proximate region) that are located between the z-plane and a proximate end of the rotor. This arrangement places the center of mass of the wheel above these points (which are typically less than approximately 1.5 diameters in length from the proximate end of the rotor) and, overall, creates a very unstable condition for balancing the wheels and is typically the manufacturing process constraint.

In one example, an exemplary distal region of a joint has a length $\Delta h_d$ of approximately 1.6 distal region guide wall diameters (e.g., $d_3$). In comparison, a conventional boreless compressor wheel may have a comparatively small distal guide section with a length of approximately 0.4 distal guide wall diameters that does not extend to or beyond a compressor wheel's z-plane.

Various exemplary ratios presented herein may be used for various size compressor wheels and/or shafts (i.e., may be scalable). In addition, various features of the exemplary compressor wheel rotors presented herein can simplify manufacturing. In various examples, replacement of conventional compressor wheels with exemplary compressor wheels does not require any modifications to other components of a turbocharger, supercharger, etc.

Figure 10:
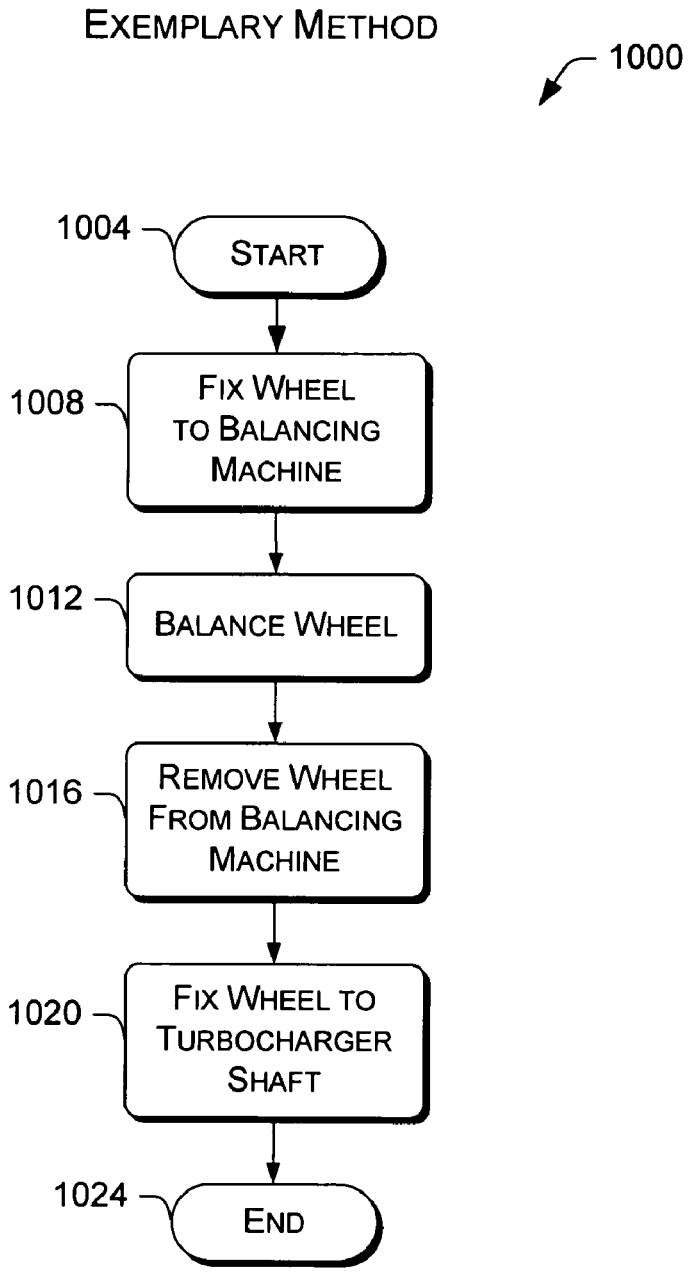
FIG. 10 is a block diagram of an exemplary method for balancing a compressor wheel.

FIG. 10 shows a block diagram of an exemplary method 1000. The method 1000 commences in a start block 1004, which includes providing a compressor wheel and a balancing machine having a balancing spindle. In a fixation block 1008, the compressor wheel, having an exemplary joint, receives the balancing spindle in the joint to a depth that includes a distal region having an elliptical end shape. For example, an operator may insert a balancing spindle into to the joint to a depth to or beyond the z-plane of the compressor wheel. A balance block 1012 follows wherein a balancing process occurs. In general, balancing is dynamic balancing. After the balancing, in a removal block 1016, the balancing spindle is removed from the joint of the compressor wheel. Next, in another fixation block 1020, the compressor wheel chamber receives an operational shaft, such as, a turbocharger shaft. For example, an operator may insert a compressor shaft into to the joint to a depth less than the z-plane of the compressor wheel. The method 1000 may terminate in an end block 1024. The method 1000 optionally includes another balancing block wherein the compressor wheel and operational shaft are balanced as an assembly.

The exemplary method 1000 and/or portions thereof are optionally performed using hardware and/or software. For example, the method and/or portions thereof may be performed using robotics and/or other computer controllable machinery.

As described herein such an exemplary method or steps thereof are optionally used to produce a balanced compressor wheel. Various exemplary compressor wheels disclosed herein include a proximate end, a distal end, an axis of rotation, a z-plane positioned between the proximate end and the distal end, and a joint having an axis coincident with the axis of rotation and an end surface positioned between the z-plane and the distal end. Such an end surface optionally has an elliptical cross-section (e.g., radius to height ratio of approximately 3:1, etc.). Such a compressor wheel optionally includes titanium, titanium alloy (e.g., Ti6-4, etc.) or other material having same or similar mechanical properties. Such a compressor wheel optionally has a peak principle operational stress proximate to the end surface and proximate to the axis of rotation that does not exceed the yield stress. Various exemplary compressor wheels are optionally part of an assembly (e.g., a balancing assembly, a turbocharger assembly, a compressor assembly, etc.). An exemplary assembly that includes an exemplary compressor wheel and operational shaft that does not extend beyond the z-plane optionally has a reduced mass due to a space between the end of the shaft and the end of the joint and/or due to a lesser overall operational shaft length. Various exemplary compressor wheels may accept a conventional shaft (e.g., turbocharger shaft, etc.) and hence, as assembled, have a space between an end of the shaft and the end of the exemplary compressor wheel joint. Such a space is optionally vacant or at least partially filled with a substance (e.g., sleeve, gas, liquid, etc.).

CONCLUSION

Although some exemplary methods, devices and systems have been illustrated in the accompanying Drawings and described in the foregoing Detailed Description, it will be understood that the methods, devices and systems are not limited to the exemplary embodiments disclosed, but are capable of numerous rearrangements, modifications and substitutions without departing from the spirit set forth and defined by the following claims.

What is claimed is:

1. A compressor wheel comprising:

titanium;

a lower, proximate end;

an upper, distal end;

an axis of rotation;

a z-plane positioned between the lower, proximate end and the upper, distal end wherein the z-plane coincides substantially with a lowermost point of a trailing edge of a blade of the compressor wheel; and a joint having an axis coincident with the axis of rotation and an end surface positioned between the z-plane and the upper, distal end wherein, in axial cross-section, the end surface comprises an elliptical shape.

2. The compressor wheel of claim 1 wherein the joint is capable of receiving a balancing spindle and wherein a distal end of the balancing spindle extends beyond the z-plane.

3. The compressor wheel of claim 1 further comprising a balancing spindle positioned in the joint and having a distal end that extends beyond the z-plane.

4. The compressor wheel of claim 1 comprising a turbocharger compressor wheel.

5. The compressor wheel of claim 1 wherein the elliptical shape comprises a radius to height ratio of approximately 3:1.

6. The compressor wheel of claim 1 wherein the compressor wheel comprises titanium alloy.

7. The compressor wheel of claim 1 wherein the joint comprises a proximate portion, an intermediate portion and a distal portion.

8. The compressor wheel of claim 7 wherein the distal portion comprises a diameter and a length of approximately 1.6 times the diameters.

9. The compressor wheel of claim 1 wherein the peak principle operational stress of the compressor wheel occurs proximate to the end surface and proximate to the axis of rotation and does not exceed the yield stress.

10. The compressor wheel of claim 1 wherein the joint is capable of receiving a compressor shaft and wherein a distal end of the compressor shaft does not extend beyond the z-plane.

11. The compressor wheel of claim 1 further comprising a compressor shaft positioned in the joint and having a distal end that does not extend beyond the z-plane.

12. The compressor wheel of claim 11 wherein the compressor shaft comprises a turbocharger shaft.

13. An assembly comprising:

a compressor wheel, the compressor wheel comprising titanium, a lower, proximate end, an upper, distal end, an axis of rotation, a z-plane positioned between the lower, proximate end and the upper, distal end wherein the z-plane coincides substantially with a lowermost point of a trailing edge of a blade of the compressor wheel, and a joint having an axis coincident with the axis of rotation and an end surface positioned between the z-plane and the upper, distal end wherein, in axial cross-section, the end surface comprises an elliptical shape or a full radius; and a balancing spindle positioned in the joint and having a distal end that extends beyond the z-plane.

14. The assembly of claim 13 wherein the compressor wheel comprises titanium alloy.

15. An assembly comprising:

a compressor wheel, the compressor wheel comprising titanium, a lower, proximate end, an upper, distal end, an axis of rotation, a z-plane positioned between the lower, proximate end and the upper, distal end wherein the z-plane coincides substantially with a lowermost point of a trailing edge of a blade of the compressor wheel, and a joint having an axis coincident with the axis of rotation and an end surface positioned between the z-plane and the upper, distal end wherein the end surface is shaped to reduce stress; and a compressor shaft positioned in the joint and having a distal end that does not extend beyond the z-plane.

16. The assembly of claim 15 wherein the compressor wheel comprises titanium alloy.

17. A turbocharger comprising:

an end opposite the distal end of the compressor shaft of the assembly of claim 16 positioned in a turbine joint of a turbine wheel.

18. A method comprising:

inserting a balancing spindle into a closed-end joint of a compressor wheel to a depth beyond the z-plane of the compressor wheel;

balancing the compressor wheel;

removing the balancing spindle; and inserting a compressor shaft into the closed-end joint of the compressor wheel to a depth that is not beyond the z-plane of the compressor wheel.

19. The method of claim 18 wherein the step of inserting the balancing spindle to the depth beyond the z-plane includes stabilizing the compressor wheel for the balancing.

* * * * *